United States Patent [19]

Kasahara et al.

[11] Patent Number: 5,006,891

[45] Date of Patent: Apr. 9, 1991

[54] IMAGE FORMING APPARATUS CAPABLE OF PERFORMING SERIAL PAGE COPY

[75] Inventors: Seitaro Kasahara; Haruo Itakura; Susumu Kurihara, all of Hachioji, Japan

[73] Assignee: Konica Corporation, Tokyo, Japan

[21] Appl. No.: 552,939

[22] Filed: Jul. 16, 1990

[30] Foreign Application Priority Data

Jul. 18, 1989 [JP] Japan ..... 1-185100

[51] Int. Cl.[5] ..... G03G 21/00

[52] U.S. Cl. ..... 355/208; 355/25; 355/218; 355/311; 355/313

[58] Field of Search ..... 355/25, 208, 209, 218, 355/311, 313

[56] References Cited

U.S. PATENT DOCUMENTS

| | | | |
|---|---|---|---|
| 4,392,740 | 7/1983 | Ito et al. | 355/313 |
| 4,763,163 | 9/1988 | Hamano et al. | 355/314 |
| 4,812,881 | 3/1989 | Kumamoto et al. | 355/208 |
| 4,908,672 | 3/1990 | Ito | 355/311 X |

*Primary Examiner*—Fred L. Braun
*Assistant Examiner*—Patrick Stanzione
*Attorney, Agent, or Firm*—Finnegan, Henderson, Farabow, Garrett, and Dunner

[57] ABSTRACT

The invention provides an image forming apparatus capable of performing an ordinary copy mode, whereby the entire surface of a document is scanned by an image reader to copy the entire surface on a copy sheet, and a serial page copy mode, whereby first and second half portions of the document are separately scanned to copy each half portion on a separate copy sheet. In the apparatus, copy sheets of different sizes are fed from a plurality of cassettes each storing a copy sheet of a predetermined size or a manual feed tray. There is provided a memory for memorizing a serial copy sheet size to be fed from the manual feed tray. When the serial page copy mode is selected in the manual feed mode, the image reader is controlled to separately scan the first and second half portions of the document on the basis of the serial copy sheet size.

6 Claims, 12 Drawing Sheets

(b)

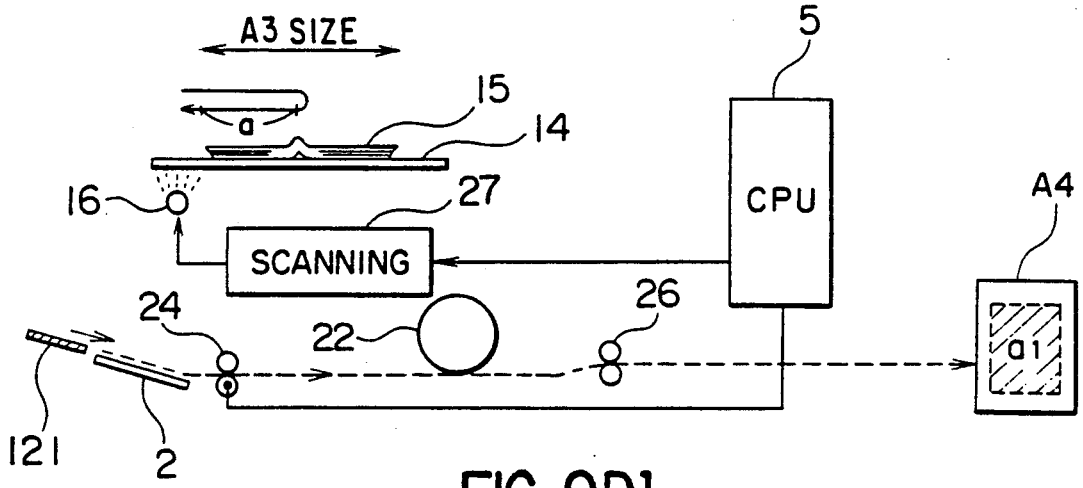
FIG. 9D1
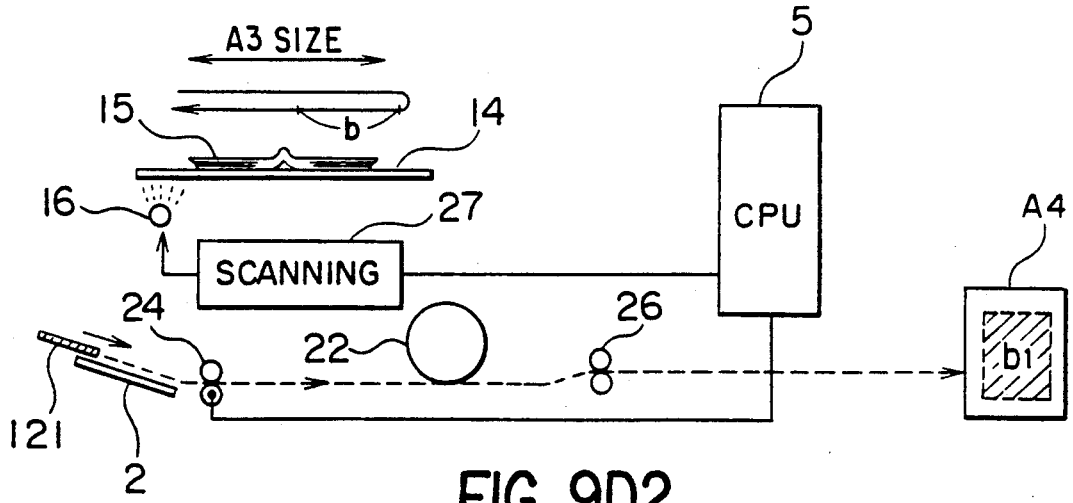
FIG. 9D2

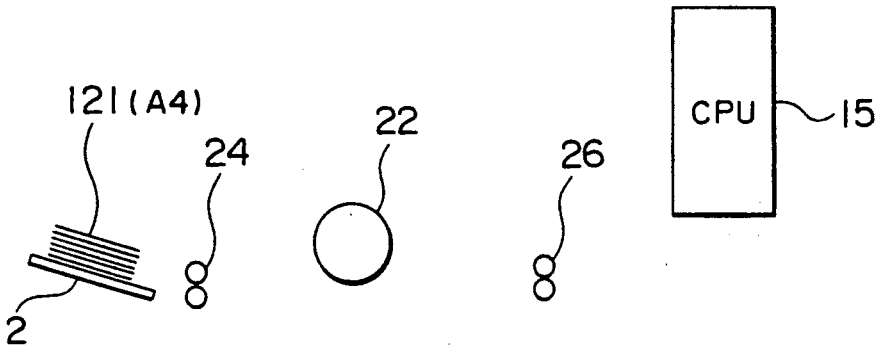
FIG. 9E1
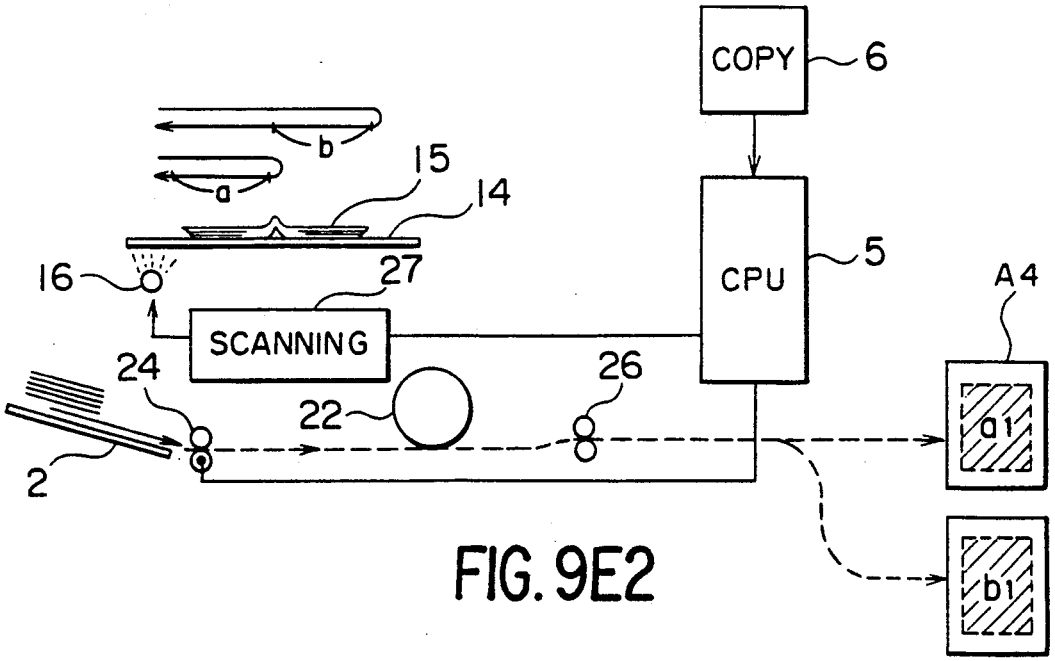
FIG. 9E2

IMAGE FORMING APPARATUS CAPABLE OF PERFORMING SERIAL PAGE COPY

BACKGROUND OF THE INVENTION

The present invention relates to an image forming apparatus of a copying machine having a function of serial page copy (book-copy function).

When copying pages of a book on a single page at a time basis, a page to be copied in the book needs to be moved for each page copying, which is sometimes inconvenient, especially when the number of pages to be copied is large or the book is thick. In order to overcome this inconvenience, there has been developed a copying machine having a function of serial page copying wherein an optical system scans successively each of two pages in a spread of the book and thereby two pages in the spread can be copied automatically without the necessity of moving the book.

When a key for serial page copy on the aforesaid copying machine is pressed for the serial page copy, the copying machine detects whether the paper size selected in it is either A4 or B5, and if it is A4 or B5, a display lamp indicating that the serial page copy is ready is lit and the serial page copy is performed after a copy key is pressed.

On the conventional copying machine mentioned above, the serial page copy can be performed only when the selected paper (cassette) size is detected to be the size of A4 or B5. The basis for this is that the positions for both first page 130 and second page 140 of a document accord with the position of an image-transfer paper as shown in FIGS. 7 (*a*) and (*b*) in this case, and thereby the independent copying for the first page and that for the second page can be performed in series through the respective scannings (shown with arrows in the figure) of an optical system. In the manual feed mode, there is no means for detecting paper size due to the mechanism of the apparatus, and thus it is impossible to recognize the size, which makes the serial page copy impossible to perform. Thus, the serial page copy in the manual feeding mode has been impossible despite the actual image-transfer paper size of A4 or B5. There has been, therefore, a problem of a narrow range for the application of serial page copy.

When cassettes in R-series such as A4R and B5R are used, the positions of both first page 130 and second page 140 of a document do not accord with the position of transfer paper 121 (shown with dotted lines in FIG. 7 (*c*)) and the document and the transfer paper do not agree in terms of their longitudinal and lateral directions and thereby the page serial copy can not be performed.

Further, users are generally using cassettes of an 'R series such as A4R or B5R, and when users having no cassettes of the size of A4 and B5 make copies in a serial page copy mode, they need to buy cassettes of A4 and B5, which is inconvenient for users.

Furthermore, it is also considered that the serial page copy for the papers which are neither of an A4 size nor of a B5 size is requested by users.

SUMMARY OF THE INVENTION

The present invention has been devised to solve the problems mentioned above and its object is to provide a convenient copying machine wherein serial page copy can be performed even in a manual feed mode and thereby the scope of application for serial page copy is broadened.

An image forming apparatus of the invention is characterized in that it is provided with a means for registering an imaginery paper size to be used in serial page copy when a manual feed mode is selected as a paper feeding mode and with a means for copying, in serial page copy on a manual feed mode, under an assumption that the actual size of a paper used is the same as the aforesaid imaginery paper size registered.

When serial page copy is selected for its implementation in a manual feed mode, an optical system (an exposure lamp and reflection mirrors etc.) scans for copying under judgment that there are used papers whose size is identical to the registered imaginery paper size, although a size of a paper actually used is not recognized.

Incidentally, in the invention, the serial page copy can be applied on one sheet of document so that first and second half portions of the document are separately scanned to copy each half portion on a separate copy sheet.

DESCRIPTION OF THE PREFERRED EMBODIMENT

An outline of a typical image-forming apparatus capable of performing serial page copy in a manual feed mode will be explained as follows, referring to drawings.

Serial Page Copy in case of using A4 or B5 cassette

Figure 8A:
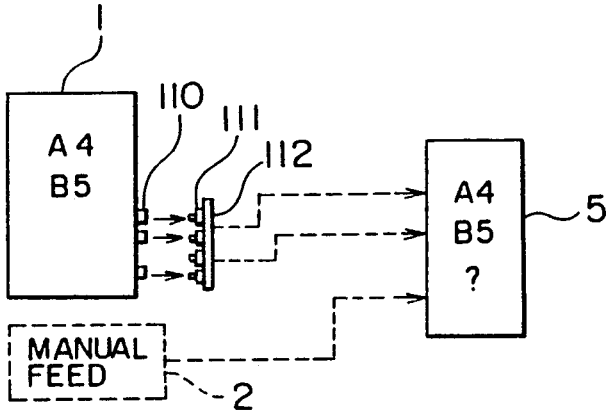
Figure 8B:
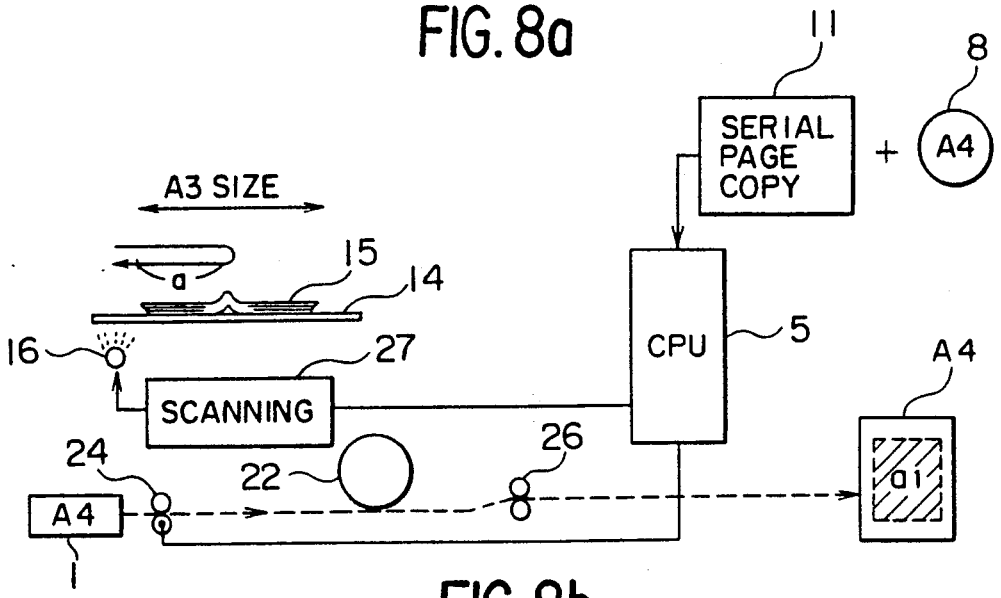
Figure 8C:
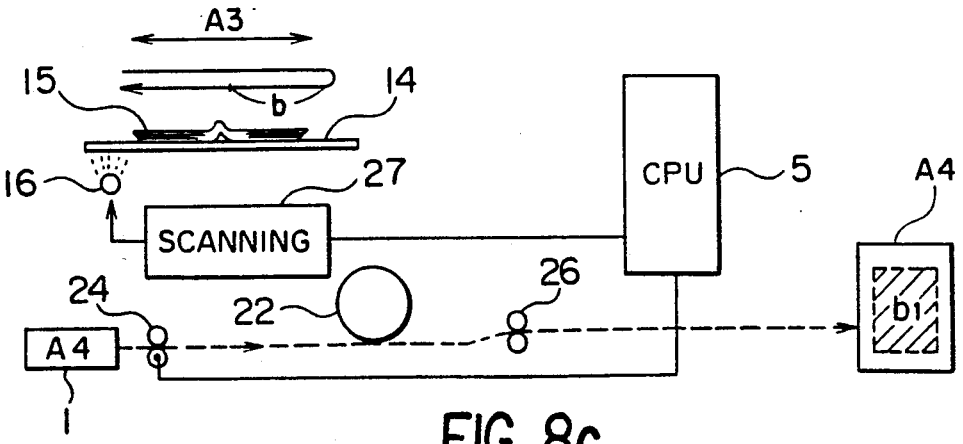

As shown in FIG. 8 (*a*), each of A4 and B5 cassettes is provided with different protruded pattern 110 which enables CPU 5 to recognize that A4 cassette or B5 cassette is loaded in the apparatus in a usable state.

As shown in FIG. 8 (*b*), when book 15 is placed, in a form of its spread, on platen 14, serial page copy key 11 is pressed under the aforesaid condition, and A4 size is selected by pressing paper size selection key 8, then CPU 5 instructs scanning means 27 to cause optical system 16 to scan across the range 'a'. A paper loaded in A4 cassette 1 is transported to photoreceptor drum 22 through second paper feed roller 24, and is ejected through paper-ejection roller 26 after contents al on the first page of book 15 have been transferred onto the paper.

Next, as shown in FIG. 8 (*c*), optical system 16 scans across the range 'b' and thereby the contents b1 on the second page of book 15 are transferred onto a paper. Even when a B5 size paper is selected, the same actions are taken.

Serial Page Copy on Manual Feed Mode

As shown in FIG. 8 (*a*), it is possible for an operator to load freely any of B5-size, A4-size, B4-size and A3-size papers on manual feed tray 2, and there is no paper size detection means like protrusion 110 provided on an A4 cassette. Therefore, CPU can not recognize the size of a paper in use, thus it has been impossible to perform serial papge copy.

Figure 9A:
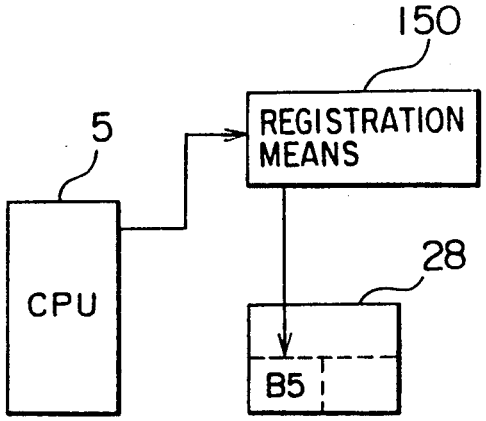
Figure 9B:
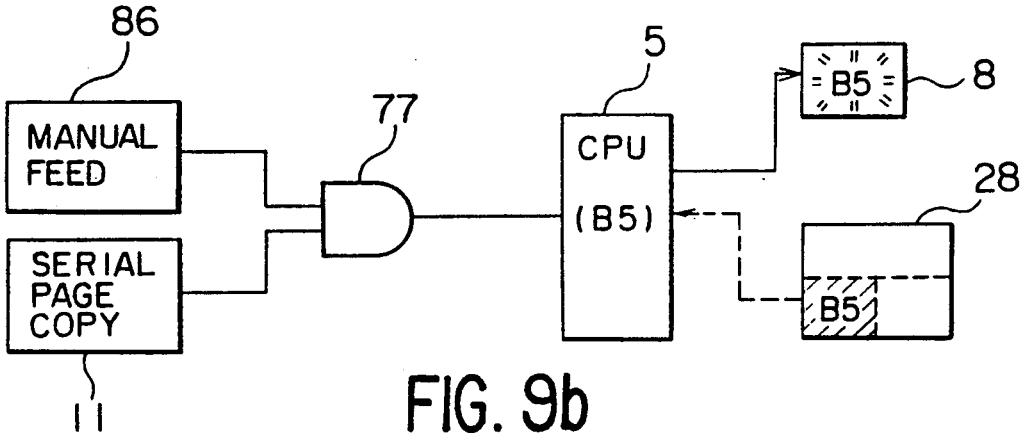
Figure 9C:
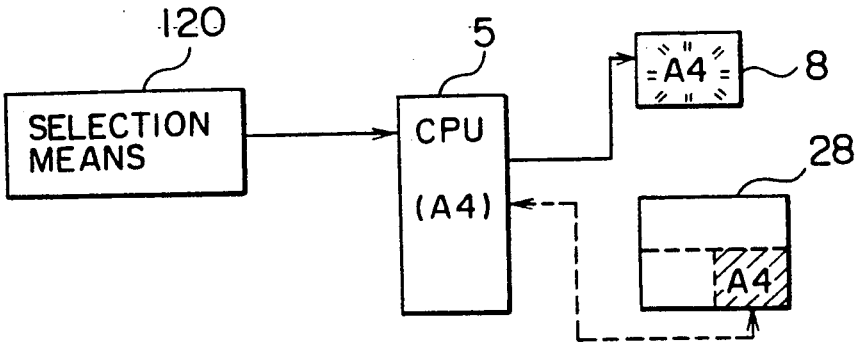

As shown in FIG. 9 (*a*), therefore, the size considered to be desirable for serial page copy on a manual feed mode (hereinafter referred to as 'virtual paper size', 'hyphothetical sheet size', 'serial page copy paer size' or 'manual paper feed serial page copy size', and it is usually an A4 size or a B5 size) is registered in register 28 in advance by the use of registering means 150.

Next, as shown in FIG. 9 (*b*), when both manual feed mode selection key 86 and serial page copy key 11 are pressed concurrently and thereby both modes are set simultaneously, this is detected by simultaneous-mode detection means 77 and is communicated to CPU 5. Then, CPU 5 reads virtual paper size B5 registered in register 28 and displays it on display means 8.

When changing to A4 size, it is communicated to CPU 5 by means of selection means 120 and then CPU 5 registers the A4 size into register 28 as a virtual paper size and displays it simultaneously on display means 8.

In case of a manual feed mode for a single sheet of paper, a sheet of paper of any size (desirable size is an A4 size but not limited to that size) 121 is set on manual feed tray 2 as shown in FIG. 9 (D1). Then, the paper is transported automatically, and CPU 5 judges equally, regardless of the size of the paper used actually, that the paper whose size is the same as a virtual paper size (A4) is used and causes optical system 16 to scan, and performs copying. Thus, the content of al on the first page is copied.

Next, when the second paper 121 is set on manual feed tray 2 as shown in FIG. 9 (D2), the content b1 on the second page of book 15 is copied.

In the case of a stack manual feed mode, a stack of plural papers 121 (e.g. A4 size) are set on manual feed tray 2 as shown in FIG. 9 (E1) after the condition shown in FIG. 9 (*c*).

Next, when copy key 6 is pressed as shown in FIG. 9 (E2), content al on the first page is copied first and then, content b1 on the second page is copied automatically.

Figure 10:
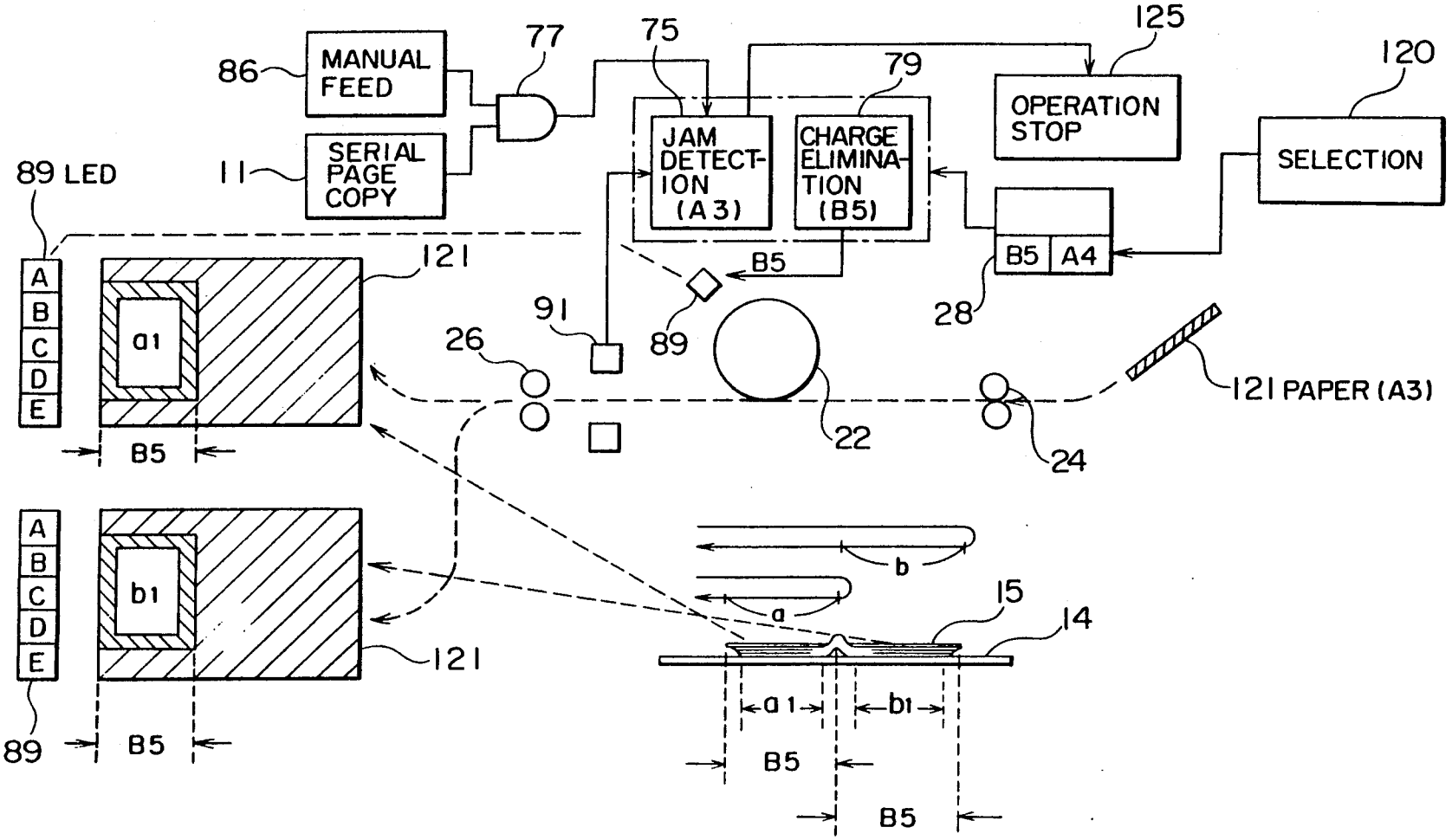
FIG. 10 is a diagram illustrating actions of charge elimination and paper-jam-detection performed when both charge elimination manual feed mode and serial page copy mode are selected in the typical example of an apparatus of the invention.

Charge Elimination and Jam Detection in Serial Page Copy on Manual Feed Copy (FIG. 10)

In copying machines, the charge elimination on non-image areas and on circumferential margin areas both on photoreceptor drum 22 is generally conducted for clean copies. When both manual feed mode and serial page copy mode mentioned above are set simultaneously, the charge elimination that is different from ordinary one is conducted.

As shown in FIG. 10, charge elimination is conducted by lighting LED (light emitting diode) array 89. Regardless of the size (e.g. A3 size) of paper used actually, charge eliminating means 79 judges equally that the virtual size (e.g. B5 size) read from register 28 is used, and controls elimination LED array 89 based on the B5 size for charge elimination. Therefore, charge elimination under the assumption of B5 size is conducted as shown on the left side in FIG. 10 even if the size of paper 121 used actually is A3. In the figure, non-image area for charge elimination is hatched by solid lines in the direction from a right upper portion to a left lower portion, while a circumferential margin area for charge elimination is hatched by solid lines in the direction from a left upper portion to a right lower portion.

Jam detecting means 75 for detecting paper jam measures the period of time during which the image-transferred paper 121 passes through paper ejection sensor 91, and when the time period is longer than the standard period of time, jam detecting means 75 judges that paper jam is existing and causes operation stop means 125 to stop the operation of a copying machine. When both manual feed mode and serial page copy mode are set simultaneously, however, jam detection is made according equally to the maximum paper size (A3) usable in the machine after the recognition of simultaneous setting of two modes, because the virtual paper size (e.g. B5) does not always agree to the size (e.g. A3) of paper 121 used actually. Thereby, the machine is prevented to judge erroneously, indicating that paper jam is existing in the machine.

An example of the invention will be explained as follows, referring to the drawings.

Figure 1:
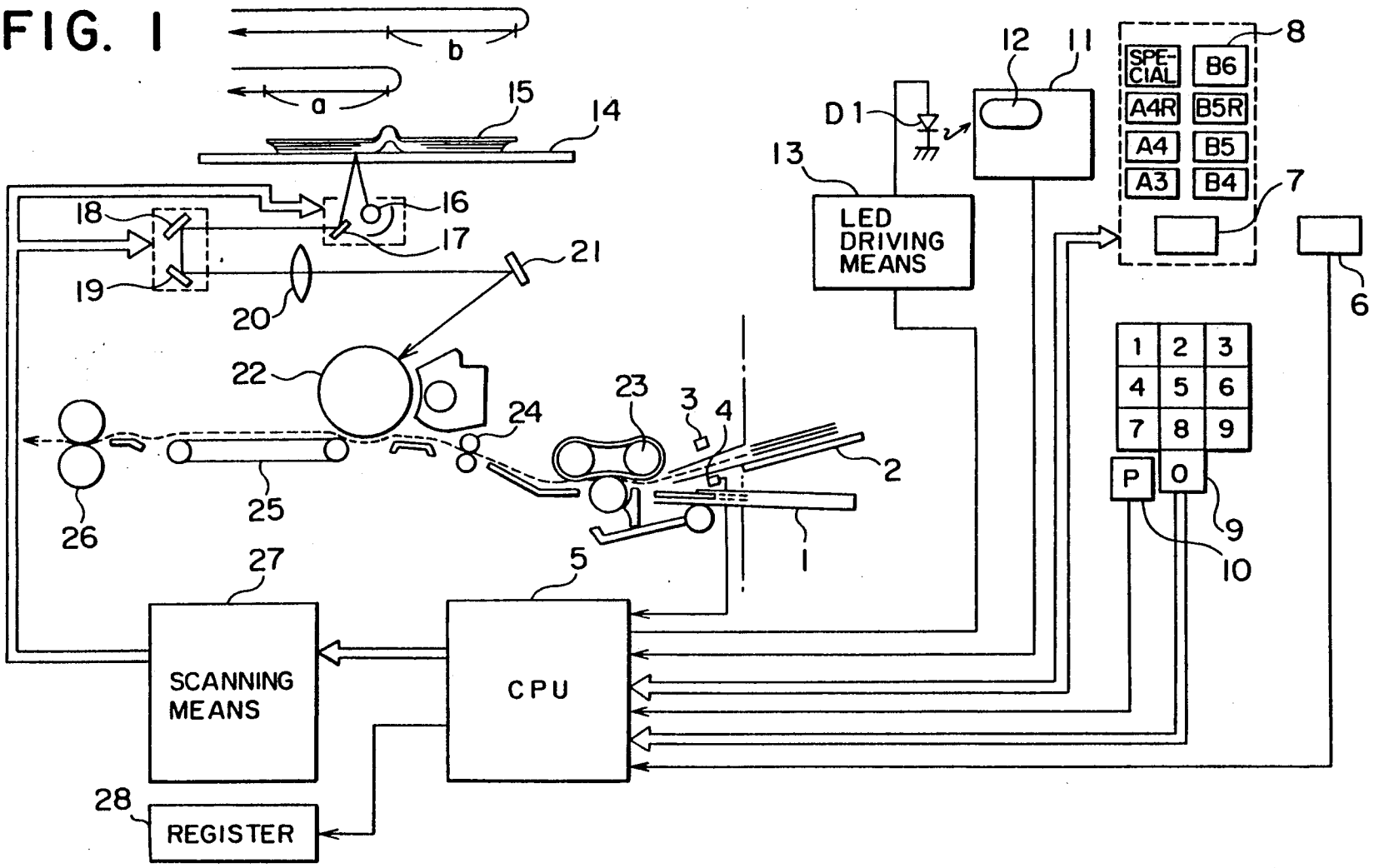
FIG. 1 shows constitution of an example of image forming apparatus (a copying machine) of the invention.

FIG. 1 shows constitution of an example of an image forming apparatus (a copying machine) of the invention.

In the image forming apparatus in this example, there are provided cassette 1 wherein papers of a predetermined size are to be loaded and manual feed tray 2 wherein papers are to be loaded in a manual feed mode. Normally, a plurality of cassettes 1 wherein papers in different sizes are loaded respectively are provided, but for avoiding complexity in the diagram, only one cassette is shown.

When a manual feed mode is selected and papers are loaded in manual feed tray 2, such information is detected by a sensor composed of light-emitting element (light-emitting diode) 3 and photoreceptor element (photodiode) 4, and signals thus obtained from the detection are inputted in CPU 5 which controls totally all actions of a copying machine.

An operation panel is provided with copy key 6, paper size selection key 7, paper size indicator 8, ten key 9, P key 10 as an input mode change-over key and serial page copy key 11. On the upper portion at left side of serial page copy key 11, there is provided serial copy mode indicator 12, and when LED-driving means 13 drives light-emitting diode D1 based on the command of CPU 5, a part of its light is guided outside.

In FIG. 1, book 15 is placed, in a form of its spread, on platen 14, and when copying, light of exposure lamp 16 reflected on the surface to be copied enters drum 22 through mirrors 17, 18 and 19, principal lens 20 and reflection mirror 21, to form electrostatic latent images on the drum.

An image-transfer paper is transported to drum 22 by first paper-feeding roller 23 and second paper-feeding roller 24, and then delivered outside through conveying means 25 and paper-ejecting roller 26.

In copying operation, scanning means 27 causes a unit composed of exposure lamp 16 and reflecting mirror 17 as well as a unit composed of reflecting mirrors 18 and 19 to travel respectively for their own stroke and at their own speed. When performing serial page copy, aforesaid exposure lamp 16 and so on are moved along the range 'a' for copying of that range, and then are moved along the range 'b' for copying of that range.

In register 28, an imaginery paper size for serial page copy in a manual feed mode (hereinafter referred to as a manual feed-serial copy size) is to be stored. Since the size of a paper actually used in a manual feed mode is unable to be recognized, the size of a paper actually used is judged to be the same as the registered manual feed-serial copy size, and thus serial page copy is implemented. This will be explained concretely as follows.

Figure 2:
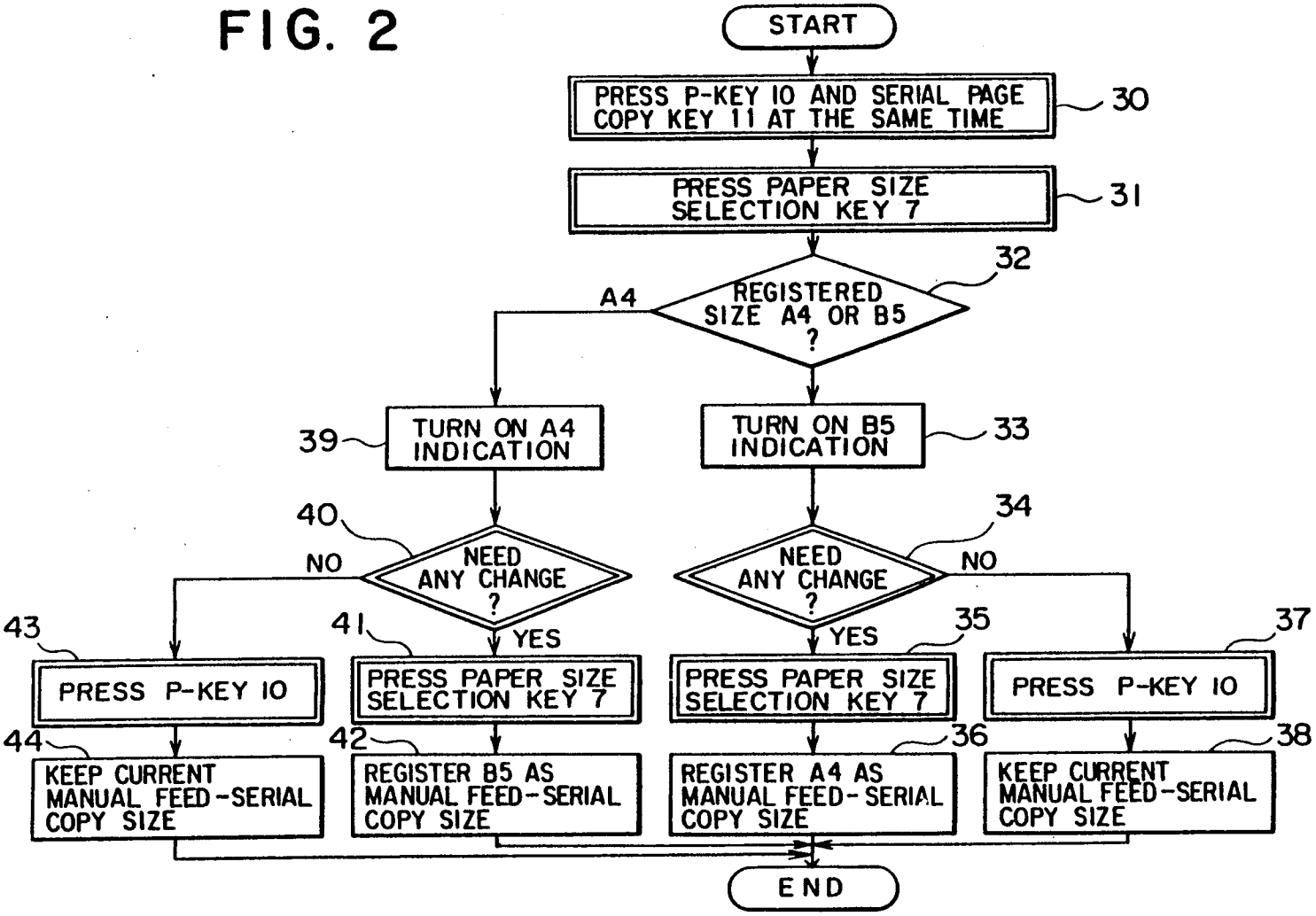
FIG. 2 is a flowchart showing the procedures for registering the paper size for serial page copy in a manual feed mode.
Figure 3:
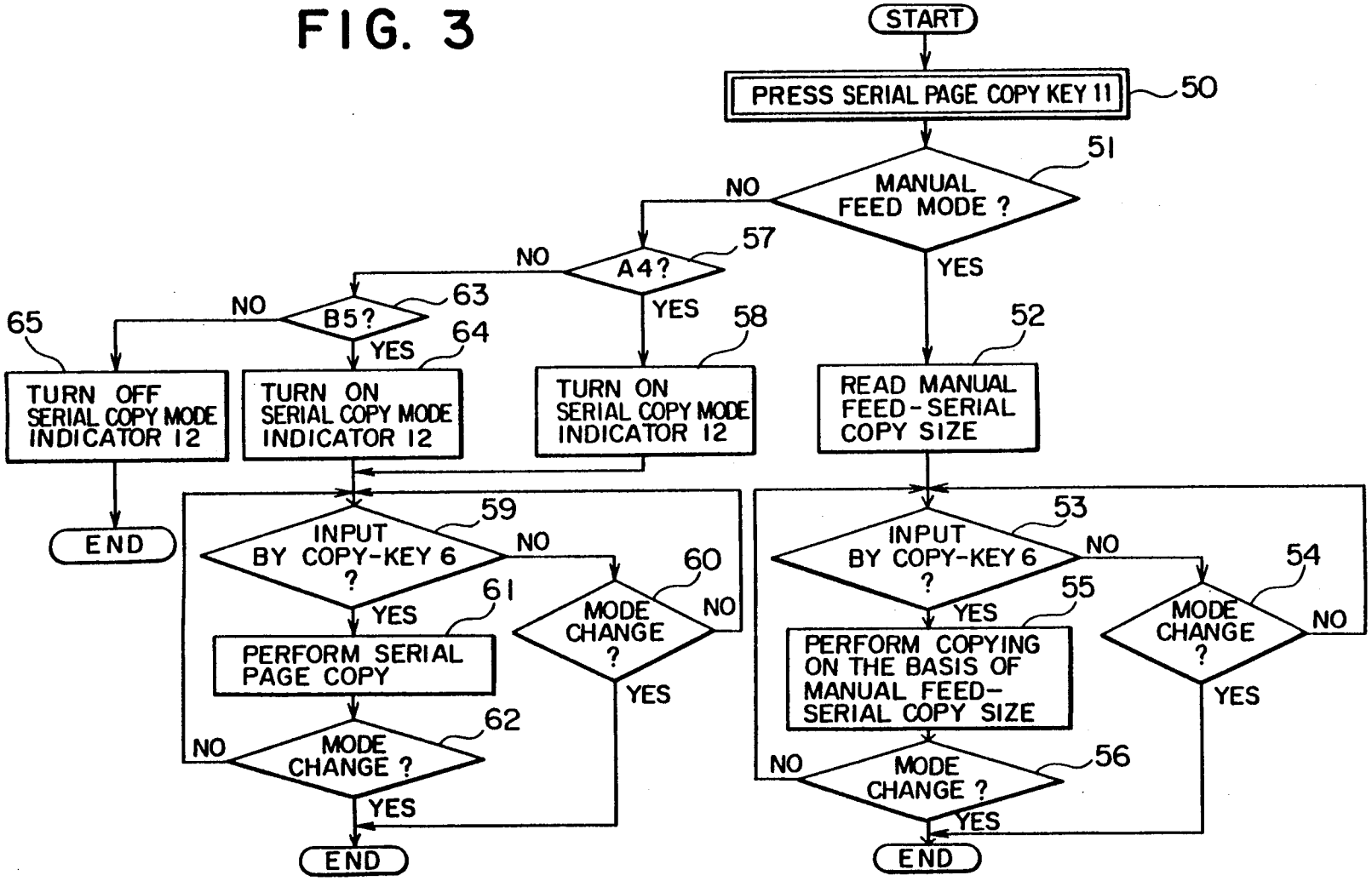
FIG. 3 is a flowchart showing the control procedures made by CPU 5 in the implementation of serial page copy.

Next, characteristic actions in the present example will be explanied, referring to FIG. 2 and FIG. 3.

FIG. 2 is a flowchart showing the procedures for registering a manual feed-serial copy size in register 28 in advance.

In the figure, actions to be taken by an operator are enclosed with double lines and thereby are distinguished from those taken by a copying machine itself.

In the present example, the size capable of being registered as a manual feed-serial copy size is either A4 or B5, and these sizes are to be switched alternately for the registration.

First, an operator presses P key 10 and serial page copy key 11 concurrently for setting the mode for registering a manual feed-serial copy size (step 30), and then presses paper size selection key 7 (step 31).

CPU 5, after receiving an input of the foregoing, judges the size registered in register 28 whether it is A4 or B5 (step 32), and when it is a B5 size, CPU 5 lights the display of B5 in paper size indicator 8 (step 33). The operator, after watching the display, judges whether it is necessary to change the manual feed-serial copy size or not (step 34) and, if necessary, presses paper size selection key 7 (step 35). Following this, CPU 5 registers A4 size in register 28 as a manual feed-serial copy size (step 36). When the manual feed-serial copy size of B5 does not need to be changed, the operator presses P key 10 (step 37). In this case, CPU 5 keeps the existing manual feed-serial copy size (step 38).

In step 32, if the existing manual feed-serial copy size registered is a A4 size, the display of A4 is lit (step 39). The operator judges whether it is necessary to change the manual feed-serial copy size or not (step 40), and if necessary, presses paper size selection key 7 (step 41), thereby B5 is registered as a manual feed- serial copy size (step 42). When no change is needed, P key 10 is pressed (step 43) and thereby CPU 5 maintains the existing manual feed-serial copy size (step 44).

Further, in order to simplify operator's actions, it is also possible to employ a method wherein the paper size registered in register 28 is caused to be indicated after the serial page copy mode and the manual feed mode are selected by the operator, and paper size selection key 7 is caused to have only the function for switching between B5 and A4 without having its original function for selecting paper sizes, when both the serial page copy mode and the manual feed mode are selected together. In this case, a single touch on paper size selection key 7 made by the operator changes the indication of B5 to that of A4 and makes it to be registered in register 28, or changes the indication of A4 to that of B5 and makes it to be registered in register 28.

Thus, it is possible to select freely either A4 or B5 at need. Furthermore, it is possible to employ a system wherein an A4 size is written on all registers 28 by a manufacturer before shipment thereof so that the A4 size may be selected automatically as a manual feed-serial copy size without the necessity of any adjustment made by the user, for the implementation of serial copy.

FIG. 3 is a flowchart showing the control procedures of CPU 5 for the operation of serial page copy.

After serial page copy key 11 is pressed first by the operator (step 50), CPU 5 judges whether a manual feed mode is selected or not (step 51) and if it is selected, a manual feed-serial copy size in register 28 is read (step 52).

Next, judgment is made whether an input by means of copy key 6 is made or not and whether the change of mode is required or not (step 53, step 54), and when inputted by copy key 6, scanning means 27 is instructed with an assumption that the size of a paper used is the same as the manual feed-serial copy size which has been read, and serial page copy is performed (step 55). Then, judgment is made whether the change of mode is required or not (step 56), and if no change is required, the sequence returns to step 53.

When the mode is not a manual feed mode in step 51, an ordinary page copy is performed. In this case, judgment is made whether the cassette size then selected is A4 or not (step 57), and if it is A4, serial copy mode indicator 12 is lit (step 58), thus showing to the operator that serial page copy is ready.

After that, judgment is made whether an input by means of copy key 6 is made or not and whether the change of mode is required or not (step 59, step 60). When an input is made by copy key 6, serial page copy is performed (step 61) and when no change of mode is required (step 62), the sequence returns to step 59.

When the size selected is not an A4 size in step 57, judgment is made whether the size is B5 or not (step 63), and when it is B5, serial copy mode indicator 12 is lit to show that serial copy is ready (step 64), and judgment is made whether an input is made by copy key 6 or not and whether an input instructing the change of mode is made or not (step 59, step 60). When an input is made by copy key 6, serial page copy is performed (step 61) and when no input for the change of mode is made (step 62), the sequence returns to step 59.

In step 63, when the size of a paper selected is not B5 either, serial copy mode indicator 12 is lit to show that serial page copy is not ready (step 65), and the sequence is ended.

The invention has been explained above, referring to an example, and the invention is not limited to the example and is able to be embodied in various varieties.

For example, an A4 size or a B5 size may be designated through the mechanical switching means in stead of registering a manual feed-serial copy size in advance. Namely, a manual feed-serial copy size in the invention may be registered either electrically or mechanically.

Further, if the paper size other than A4 or B5 also allows serial page copy to be performed due to the structural arrangement of an image forming apparatus, such size may naturally be registered as a manual feed-serial copy size.

EXAMPLE 2

Figure 4:
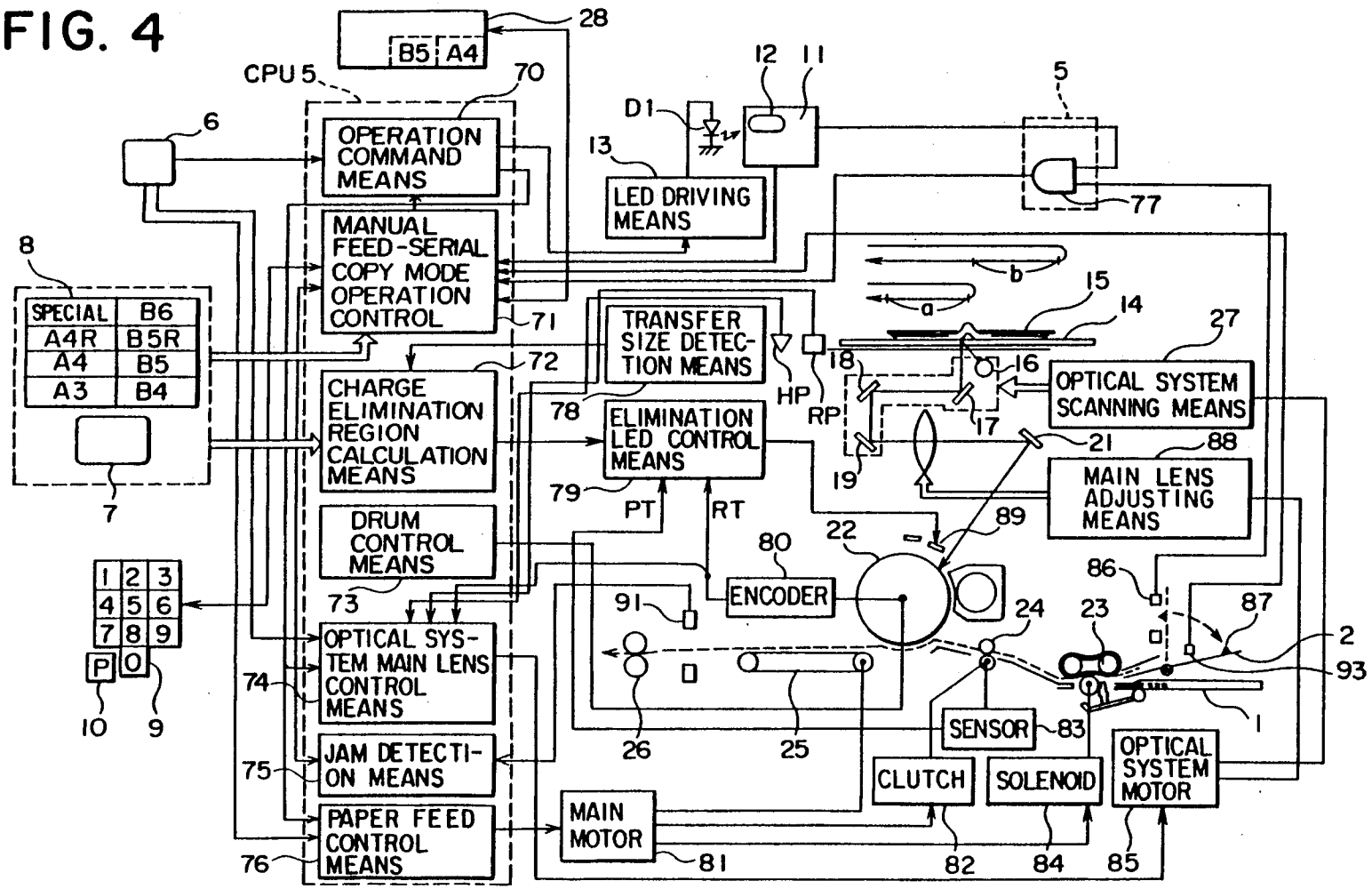
FIG. 4 is a block diagram showing constitution of the second example of the invention.

FIG. 4 is a block diagram showing the composition of the second example of the invention.

In the example, action of each portion is controlled by each function block. The function block is a means for realizing the specific function established as the result of what a hardware acts following a software.

As a function block in the example, CPU 5 is provided therein with manual feed-serial page copy mode operation control means 71 that controls totally the actions when a manual feed mode and a serial page copy mode are set simultaneously, operation command means 70 that commands operations, charge elimination region calculation means 72, drum control means 73, optical system main lens control means 74, jam detection means 75, paper feed control means 76, and simultaneously set modes detection means 77.

Figure 5:
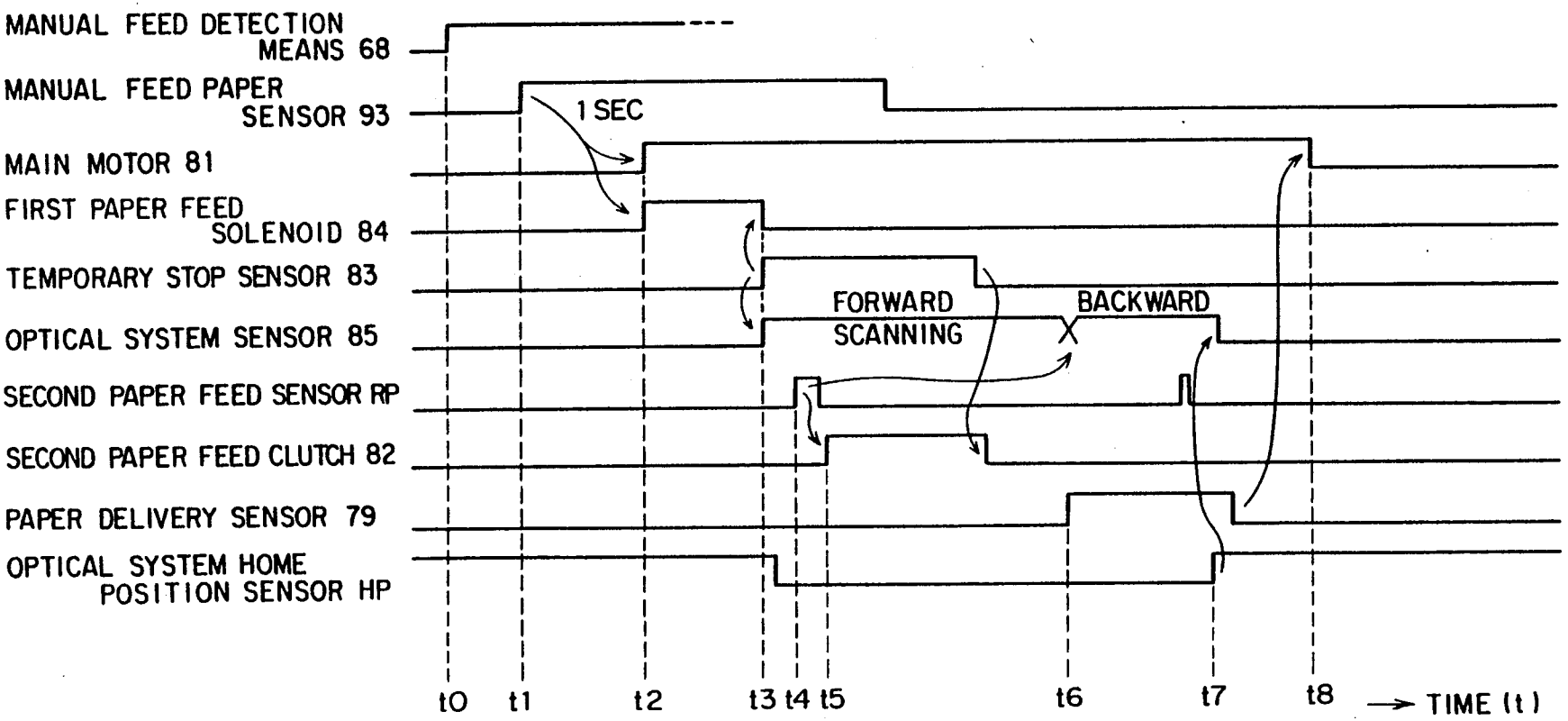
FIG. 5 is a timing chart for illustrating the actions in a manual feed mode in the example of FIG. 4, FIGS. 6 (*a*) and (*b*) are diagrams for illustrating how to move optical system 16 (tip-aligning action) to the position of the tip of the second page of a document in case of serial page copy wherein FIG. 6 (*a*) is a diagram showing the distance between second paper feed sensor RP and the tip of the first page of book 15 and the distance between second paper feed sensor RP and the tip of the second page of book 15 both converted to the pulse numbers of an encoder provided on photoreceptor drum 22, while, FIG. 6 (*b*) is a flowchart showing action procedures, FIGS. 7 (*a*)–(*c*) are diagrams showing the occasion wherein it is possible to perform serial page copy and the occasion wherein it is not possible, FIGS. 8 (*a*)–(*c*) are diagrams illustrating the serial page copy wherein cassettes of A4 and B5 sizes are used in the typical example of an apparatus of the invention, FIGS. 9 (*a*)–(E2) are diagrams illustrating copying actions conducted when both manual feed mode and serial page copy mode are selected simultaneously in the typical example of an apparatus of the invention.

FIG. 5 is a timing chart illustrating the operations in the example in FIG. 4 and it shows the occasion of a mode for feeding a single sheet.

When manual feed tray 2 is drawn out of a main body of a copying apparatus for manual paper feeding, protrusion 87 provided on manual feed tray 2 is released from the optical path of manual feed detection sensor 86, thus causing manual feed detection sensor 86 to be turned on (time t0). After that, when transfer paper 121 is loaded on manual feed tray 2, this is detected and thereby manual feed 0-sheet sensor 93 is turned on (time t1).

After about 1 second, main motor 81 and first paper feed solenoid 84 are turned on (time t2), and a paper loaded on manual feed tray 2 is fed. When sensor 83 is turned on at time t3, paper feed is suspended momentarily and optical system motor 85 is turned on concurrently for the start of scanning of optical system 16.

When the optical system arrives at second paper feed sensor (registration sensor) RP after leaving its home position, the second paper feed sensor is turned on (time t4) and then second paper feed clutch 82 is turned on at time t5 for the start of rotation of second paper feed roller 23, thus the transfer paper is fed, for image-transferring thereon, to photoreceptor drum 22. After paper-ejection sensor 91 is turned on at time t6, jam-detection means 75 starts measuring the period of time during which the transfer paper passes through the jam-detection means. When a sensor detects that the optical system has returned to its home position HP at time t7, the transfer sequence for the first page is completed at time t8. The transfer operation for the second page is done in the same way as for the first page, but the interval between the timing (timing t4) at which second paper feed sensor RP in FIG. 5 is turned on and the timing (time t5) at which second paper feed clutch 82 is turned on is greater than that for the transfer of the first page.

Figure 6:
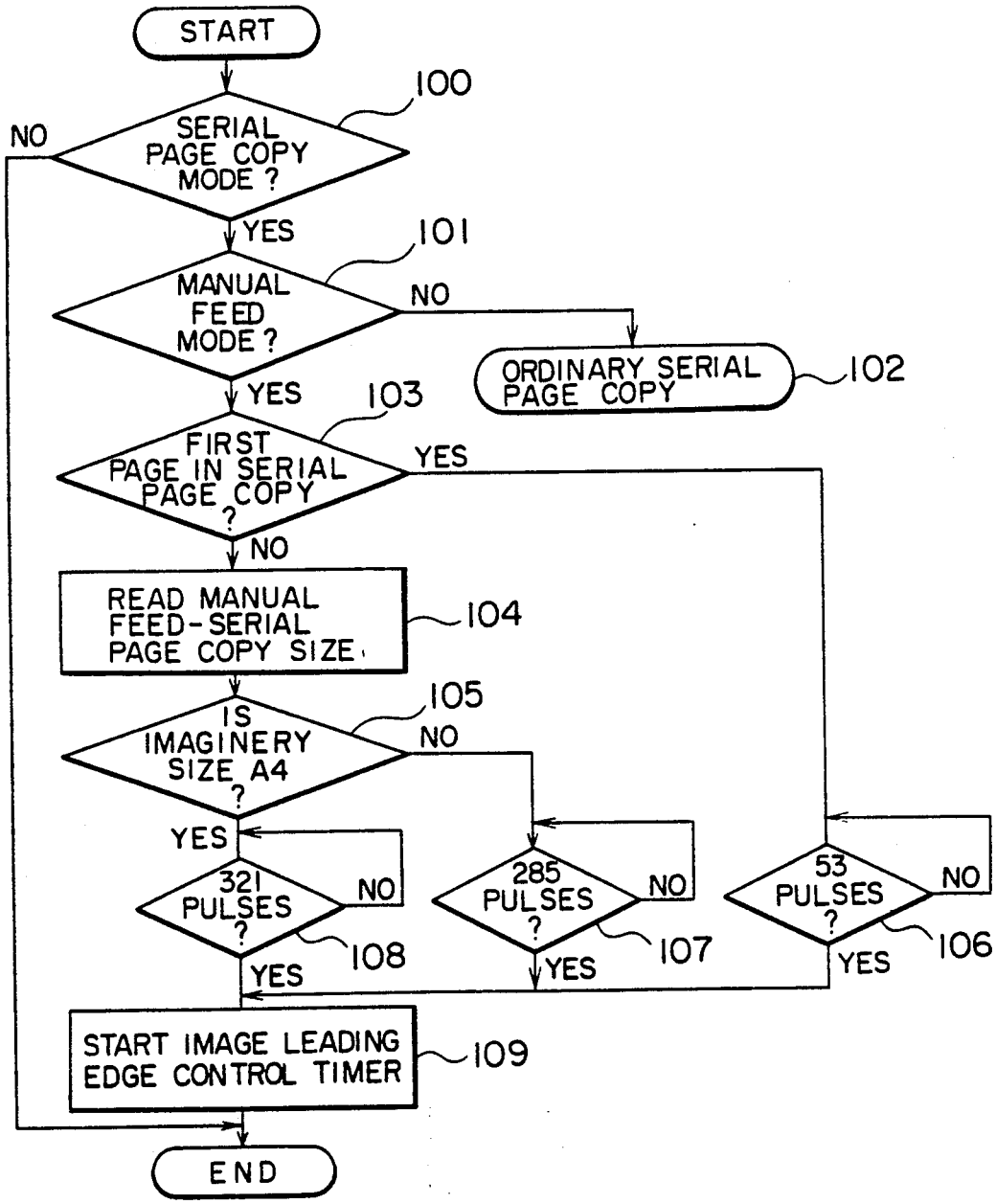
Figure 7A:
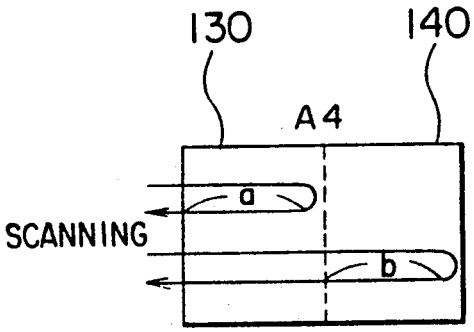
Figure 7B:
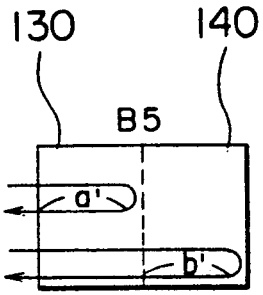
Figure 7C:
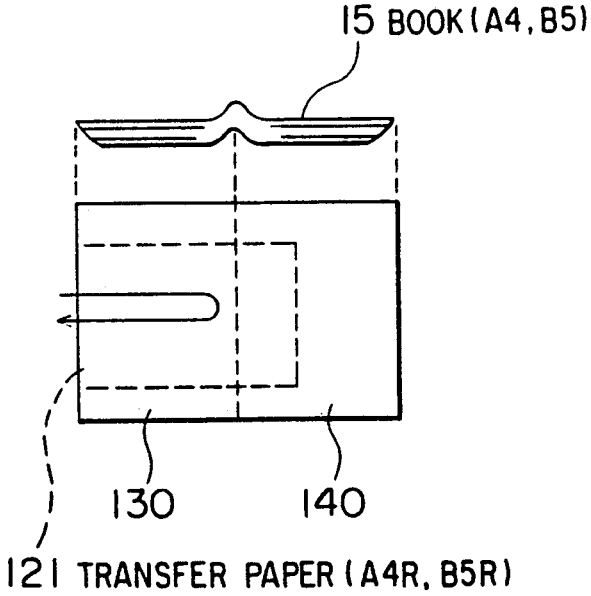

FIGS. 6 (*a*) and (*b*) are the figures for illustrating how optical system 16 is moved to the leading edge of the second page of a document (head-aligning action) on the occasion of serial page copy, wherein FIG. 6 (*a*) is a diagram showing the distance between second paper feed sensor RP and the leading edge of the first page of book 15 and the distance between paper feed sensor RP and the leading edge of the second page of book 15 both converted to the number of encoder pulses of photoreceptor drum 22, while, FIG. 6 (*b*) is a flowchart showing the procedures of actions therefor.

As shown in FIG. 6 (*a*), the distance in terms of the number of pulses between second paper feed sensor RP and the tip of stopper 92 is 53 pulses and the distance to the second page of A3 size book 15 is 321 pulses, while the distance to the second page of B5 size book 15 is 285 pulses.

Under the assumption mentioned above, the control shown in FIG. 6 (*b*) is made.

When a serial page copy mode is selected (step 100) and a manual feed mode is selected (step 101), judgment whether the first page of a document is to be copied or not is made (step 103). If so, optical system main lens control means 74 counts the encoder pulses generated from encoder 80 to 53-pulse equivalent (step 106) and the image-tip control timer is started (step 109).

When the page to be copied in step 103 is not the first page, the size for manual feed serial page copy (virtual paper size) is read from register 28 (step 104). When the virtual paper size is A4, 321 pulses are counted (step 108) and when it is not A4 size (i.e., when it is B5 size), 285 pulses are counted (step 107). After that, the image-tip control timer is started (step 109).

In the invention, as stated above, when performing serial page copy under a manual feed mode, actual copying is performed with an assumption that the size of an image-transfer paper actually used is the same as that registered in advance, thus enabling serial page copy under the manual feed mode which has been impossible so far to be performed, broadening the application scope for serial page copy and providing a convenient image forming apparatus.

Even when a manual feed mode and a serial page copy mode are selected simultaneously, it is possible to obtain nice copies, similarly to the occasion of ordinary copying because of charge elimination made for both non-image areas and circumferential margin areas.

Even when a manual feed mode and a serial page copy mode are selected simultaneously, the apparatus makes no error in judgment of paper jamming, causing no trouble, even if the virtual paper size does not agree to the size of paper used actually, because of the detection of paper jamming that is made based on the maximum paper size capable of being accepted by the apparatus regardless of the virtual paper size.

What is claimed is:

1. An image forming apparatus with a serial page copy function, wherein, when a copy for a document such as a book is carried out, the serial page copy function performs a copy for each of pages by separately sequentially scanning a first page and a second page of the document placed on a first portion and a second portion of a platen by an optical system, comprising:

serial page copy selection means;

memory means for memorizing a serial copy sheet size enabling serial page copy in case that manual feed mode is selected as a sheet feed mode and the serial page copy is to be carried out on the manual feed mode; and indication means for selecting the same sheet size as the registered serial copy sheet size when the serial page copy is carried out on the manual feed mode and indicating the size.

2. An image forming apparatus with a serial page copy function, comprising:

a platen;

an optical system for scanning a document surface of a document placed on the platen;

optical system control means for controlling a movement of the optical system;

a manual feed tray for placing thereon a transfer sheet used on manual feed mode;

a photoreceptor for forming an electrostatic latent image corresponding to a content of the document;

charge elimination means for eliminating a charge on a non-image area and a periphery margin area on the surface of the photoreceptor;

charge elimination control means for controlling an operation of the charge elimination means;

jam detection means for detecting an occurrence of sheet jam by measuring a time period for ejecting a transfer sheet having been subjected to an image transfer;

serial page copy mode selection means;

manual feed mode selection means;

simultaneously selected mode detection means for detecting both the serial page copy mode and the manual feed mode being selected simultaneously;

memory means for memorizing a serial copy sheet size enabling the serial page copy in case that both the serial page copy mode and the manual feed mode are selected simultaneously; and manual feed serial copy operation control means for totally controlling an operation in case that both the serial page copy mode and the manual feed mode are selected simultaneously;

wherein, when the simultaneously selected mode detection means detects both the serial page copy mode and the manual feed mode being selected simultaneously and send a detection signal to the manual feed - serial copy operation control means, the manual feed - serial copy operation control means reads out the manual feed - serial copy operation control means reads out the serial copy sheet size from the memory means and controls the operation on the assumption that the same size as the serial copy sheet size is currently fed by manual, thereby the charge elimination control means controls the charge elimination means to eliminate a charge on a non-image area and a periphery margin area in case that the serial copy sheet size is selected as the transfer sheet size, and the jam detection means detects an occurrence of sheet jam on the basis of a time period for ejecting a transfer sheet with the largest sheet size possibly used in the apparatus.

3. The apparatus recited in claim 2, wherein either stack manual feed mode for carrying out an image transfer by placing a plurality of stacked transfer sheets on the manual feed tray or one-sheet manual feed mode for placing one sheet of transfer sheet for every image transfer can be selected, and wherein, when the stack manual feed mode is selected, an operation is started whenever copy key is pressed after a plurality of transfer sheets have been stacked, and when the one sheet manual feed mode is selected, a copy for the document is carried out by feeding a transfer sheet to the photoreceptor whenever the transfer sheet is placed on the manual feed tray.

4. The apparatus recited in claim 2, wherein, when both the serial page copy mode and the manual feed mode are selected simultaneously and a copy for the first page of an open book is carried out, the optical system control means moves the optical system by a first distance predetermined in accordance with the read out serial copy sheet size and registers of position of the optical system with a leading edge point of the first page, thereafter the copy for the first page is carried out by scanning it by the optical system, and when a copy for the second page is carried out, the optical system control means moves the optical system by a second distance predetermined in accordance with the serial copy sheet size and registers a position of the optical system with a leading edge point of the second page, thereafter the copy for the second page is carried out by scanning it by the optical system.

5. The apparatus recited in claim 2, further comprising indication means for indicating a sheet size currently being used; and sheet size selection means;

wherein, when both the serial page copy made and the manual feed mode are selected simultaneously, the indication means indicates a specific indication informing of the simultaneously selected mode and an indication informing of the read out serial copy sheet size, and when the manual feed - serial copy operation is to be carried out by selecting a sheet size different from the indicated serial copy sheet size, by operating the sheet size selection means, an applicable different sheet size is indicated on the indication means and is registered in the memory means, thereby the manual feed - serial copy operation is carried out with the newly registered serial copy sheet size.

6. The apparatus recited in claim 2, wherein at least one among the optical system control means, the charge elimination control means for controlling an operation of the charge elimination means, the jam detection means for detecting an occurrence of sheet jam by measuring a time period for ejecting a transfer sheet having been subjected to an image transfer, the simultaneously selected mode detection means for detecting both the serial page copy mode and the manual feed mode selected simultaneously and the manual feed - serial copy operation control means for totally controlling an operation in case that both the serial page copy made and the manual feed mode are selected simultaneously, is made of a functional block for realizing a predetermined function constituted as a result of that a hard ward of computer works in accordance with a soft ware.

* * * * *

UNITED STATES PATENT AND TRADEMARK OFFICE

CERTIFICATE OF CORRECTION

PATENT NO. : 5,006,891

DATED : April 09, 1991

INVENTOR(S) : Seitaro Kasahara et al.

It is certified that error appears in the above-identified patent and that said Letters Patent is hereby corrected as shown below:

Claim 2, column 9, line 38, change "feed serial" to --feed serial--.

Claim 2, column 9, lines 48 and 49, delete [the manual feed serial copy operation control means reads out].

Claim 3, column 10, line 6, change "one sheet" to --one-sheet--.

Claim 4, column 10, line 18, after "registers" change "of" to --a--.

Claim 5, column 10, line 35, change "made" to --mode--.

Claim 6, column 10, line 62, change "made" to --mode--.

UNITED STATES PATENT AND TRADEMARK OFFICE

CERTIFICATE OF CORRECTION

PATENT NO. : 5,006,891

DATED : April 9, 1991

INVENTOR(S) : Seitaro Kasahara, et al.

It is certified that error appears in the above-identified patent and that said Letters Patent is hereby corrected as shown below:

Claim 6, column 10, line 65, change "ward" to --ware--.

Signed and Sealed this

Seventeenth Day of August, 1993

*Attest:*

*Attesting Officer*

BRUCE LEHMAN

*Commissioner of Patents and Trademarks*